United States Patent [19]

Stephens

[11] B 3,999,732

[45] Dec. 28, 1976

[54] WALL THERMOSTAT CONVERSION KIT ASSEMBLY

[75] Inventor: Norman S. Stephens, Corona, Calif.

[73] Assignee: Robertshaw Controls Company, Richmond, Va.

[22] Filed: Nov. 26, 1974

[21] Appl. No.: 527,333

[44] Published under the second Trial Voluntary Protest Program on March 23, 1976 as document No. B 527,333.

[52] U.S. Cl. ..... 248/309 R

[51] Int. Cl.[2] ..... G12B 9/00

[58] Field of Search ..... 248/27, 223, 309, 205, 248/300, 345; 337/112, 327

[56] References Cited

UNITED STATES PATENTS

| | | | |
|---|---|---|---|
| 1,716,940 | 6/1929 | Woller | 248/300 |
| 1,961,728 | 6/1934 | Arnest et al. | 248/300 UX |
| 2,731,228 | 1/1956 | Baldwin et al. | 248/309 X |
| 3,126,239 | 3/1964 | Winter et al. | 248/205 R |
| 3,210,860 | 10/1965 | Lieberman et al. | 248/27 X |
| 3,243,553 | 3/1966 | Doyle | 337/102 X |
| 3,249,721 | 5/1966 | Baak | 337/112 X |
| 3,356,840 | 12/1967 | Cohen | 248/223 X |

*Primary Examiner*—Roy D. Frazier
*Assistant Examiner*—Robert W. Gibson, Jr.
*Attorney, Agent, or Firm*—O'Brien & Marks

[57] ABSTRACT

Wall thermostat conversion kit assembly including a wall mounting bracket, a wall plate and a specially arranged fastener assembly, wherein the fastener assembly effects attachment of not only the wall plate to the bracket but also a thermostat device of more than one geometrical size to the wall plate and bracket.

3 Claims, 4 Drawing Figures

WALL THERMOSTAT CONVERSION KIT ASSEMBLY

BACKGROUND OF THE INVENTION

1. Field of the Invention

This invention relates to a wall fixture. More particularly, it relates to a wall thermostat mounting assembly for converting from one thermostat to another.

2. Description of the Prior Art

It has been the practice in the past to provide various types of wall fixtures for electric outlets or thermostat devices wherein a base or bracket is attached to the wall in some fashion and wherein the electric outlet or thermostat is hingedly or otherwise connected to the base.

The prior art is illustrative of various types of wall or ceiling fixtures as exemplified by U.S. Pats. No. 1,544,736; No. 2,225,080; and No. 2,930,876.

One of the problems associated with the prior art fixtures is that a fixture or device to be replaced usually required complete removal of the device before another fixture could be mounted in its place. Such removal of one fixture for another fixture often resulted in a time comsuming and extensive repair operation before the new or subsequent fixture could be mounted on the wall or ceiling.

SUMMARY OF THE INVENTION

The present invention is summarized in a wall thermostat conversion kit assembly including a wall plate means having a boss means, the boss means having first and second spaced apertures; a mounting bracket means having a raised portion and including flange means for effecting attachment of said bracket means to a wall; the raised portion having third and fourth spaced apertures; said wall plate means being disposable on and attachable to said bracket means upon the first aperture on said boss means being alignable with the third aperture on the raised portion whereby the alignable first and third apertures are arranged to receive a first fastener element to effect attachment of said wall plate means to said bracket means; and a thermostat device disposable on said boss means, the second aperture on said boss means being alignable with the fourth aperture on the raised portion upon attachment of said wall plate means to said bracket means, said device and the alignable third and fourth apertures to receive a second fastener element for effecting attachment of said device to said wall plate means and said bracket means.

An object of this invention is to provide a wall thermostat conversion kit assembly having a mounting bracket that is readily attachable to a wall over the remaining base or other portion of a wall thermostat that is to be replaced.

Another object of the present invention is to provide a wall thermostat conversion kit assembly having a mounting bracket and wall plate wherein the bracket and wall plate include cooperative portions for effecting rotative adjustment of the wall plate relative to the bracket.

This invention has another object in that a wall thermostat conversion kit assembly includes cooperative portions on a mounting bracket, a wall plate and a thermostat device for effecting attachment of the thermostat device to the wall plate and bracket.

Still another object of the present invention is to provide a wall thermostat conversion kit assembly having a wall plate for accommodating a thermostat device of more than one geometrical shape or size.

Other objects and advantages of the present invention will become more apparent from the following description taken in conjunction with the accompanying drawings.

DETAILED DESCRIPTION OF THE PREFERRED EMBODIMENTS

Figure 1:
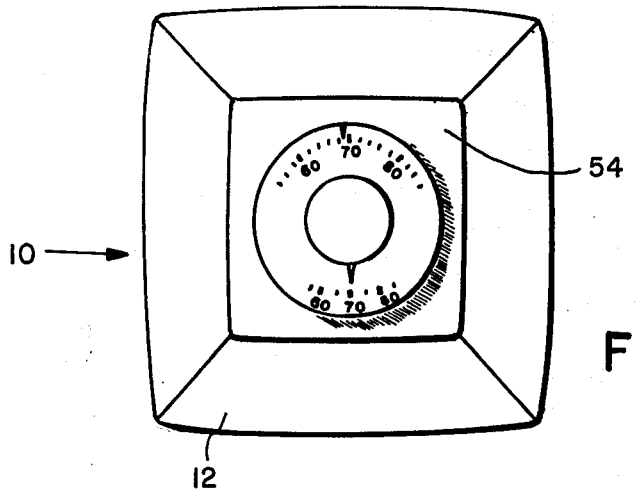
FIG. 1 is a front view of a wall thermostat conversion kit assembly embodying the present invention.
Figure 2:
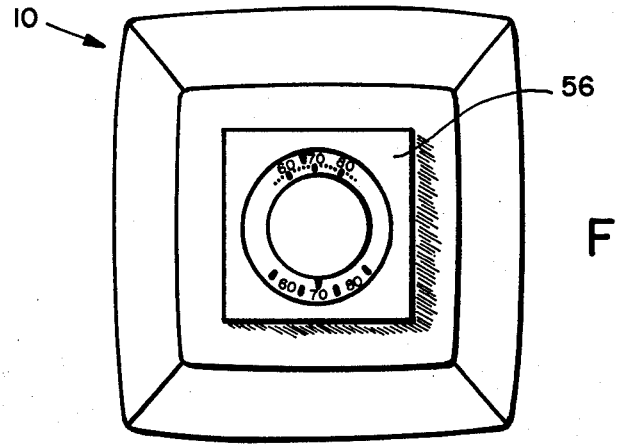
FIG. 2 is a front view of the wall thermostat conversion kit assembly of FIG. 1 but utilizing a thermostat device of smaller size than the thermostat device utilized in FIG. 1.
Figure 3:
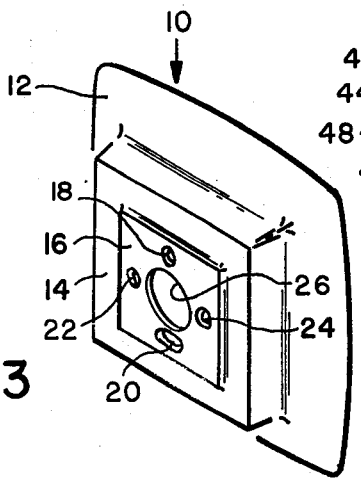
FIG. 3 is a perspective view of a mounting bracket of the instant invention.

The present invention is embodied in a wall thermsotat conversion kit assembly 10 for accommodating a thermostat device of more than one geometrical shape or size as illustrated in FIGS. 1–2. The assembly includes a wall plate 12 preferably formed from a suitable thermoplastic and moldable material of appropriate color. Wall plate 12 is of generally polygonal shape and has an outer peripheral flange portion. A first raised and upstanding boss is concentrically disposed intermediate of and connected to the outer peripheral flange portion and has a top flat surface 14 generally parallel to the outermost edge of the outer peripheral flange portion as shown in FIG. 3. A second raised and upstanding boss is concentrically disposed intermediate of and above the top surface 14 of the first boss such that the outer peripheral edge of the second boss is spaced inwardly from the outer peripheral edge of the first boss. The second boss also has a flat upper top surface 16 generally parallel to the top surface 14 of the first boss.

A first pair of laterally spaced apertures 18, 20 are provided on the second boss. A second pair of laterally spaced apertures 22, 24 are interposed between and spaced from the first pair of apertures 18, 20. The second pair of apertures 22, 24 are preferably disposed at an angle of about 90° relative to the first pair. Aperture 20 of the first pair has an extended slot configuration as illustrated in FIG. 3. An enlarged opening 26 is concentrically located on the second boss between and inwardly spaced from the first and second pairs of apertures 18, 20 and 22, 24.

Figure 4:
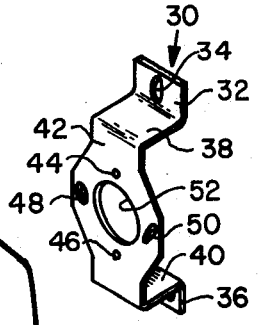
FIG. 4 is a perspective view of a wall plate of the wall conversion kit assembly of the present invention.

The wall thermostat conversion kit assembly includes a wall mounting bracket 30 formed from a length of stamped-out and die-shaped sheet metal material such as a suitable grade of sheet steel in the fashion depicted in FIG. 4. Bracket 30 includes opposed and outwardly extending flanges 32, 36 having elongated slots 34, 34 for effecting mounting and attachment of bracket 30 to a wall (not shown). Lower slot 34 may have its longitudinal axis disposed at right angles to the longitudinal axis of upper slot 34. Opposed and spaced legs 38, 40 extend upwardly from and are connected to the inner ends of opposed flanges 32, 36. A raised central portion 42 extends between and is interconnected to the upper ends of opposed legs 38, 40.

A third pair of laterally spaced apertures 44 and 46 are provided on the raised portion 42 of bracket 30 and are alignable with the first pair of apertures 18, 20 on the second boss of wall plate 12. A fourth pair of laterally spaced apertures 48, 50 are interposed between and spaced from the third pair of apertures 44, 46 on raised portion 42. The fourth pair of apertures 48, 50 on bracket 30 are alignable with the second pair of apertures 22, 24 on the wall plate 12. Each one of the fourth pair of apertures 48 and 50 is of elongated slot configuration, such that the elongated slot configuration of each aperture 48 or 50 of the fourth pair has an elongated axis that converges in a direction towards the aperture 46 of the third pair. Raised portion 42 of bracket 30 includes an enlarged opening 52 concentrically located between and inwardly spaced from the third and fourth pairs of apertures 44, 46 and 48, 50.

In attaching the assembly 10 of the present invention to a wall appropriate wall-type fasteners are passed through the slots 34, 34 of bracket 30 so as to effect seating of opposed flanges 32, 36 of the bracket against the wall while the remaining base or other suitable portion (not shown) of a removed thermostat device is interposed between and spaced from the opposed legs 38, 40 of bracket 30. Wall plate 12 is disposed on and attached to the wall bracket 30 when suitable sheet screw type fastener elements (not shown) are passed through the aligned apertures of the first and third pairs of apertures 18, 20 and 44, 46 of wall plate 12 and bracket 30. In attaching wall plate 12 to bracket 30, wall plate 12 may be rotatably adjusted relative to bracket 30 by reason of the elongated slot configuration of the aperture 20 of the first pair of apertures 18, 20 on wall plate 12. One of the advantages for rotatably adjusting wall plate 12 relative to bracket 30 is that the wall plate may be aligned relative to a vertical plane even though the bracket 30 is misaligned with respect to the vertical plane as the result of attaching the bracket to a wall and relative to the remaining portion (not shown) of a removed thermostat device.

Upon attaching wall plate 12 to bracket 30, openings 26 and 52 of the wall plate and bracket 30 define a common opening for access to the interior of the wall plate and bracket. Such access, for example, enables the user of the assembly 10 of the present invention to connect sensing and control lines (not shown) between a thermostat device to be mounted on assembly 10 and the remaining portion (not shown) of a removed thermostat device.

A large or small size thermostat device 54 or 56 is disposable on the top surface 16 of the second boss of wall plate 12. Then appropriate sheet metal fastener elements are passed through suitable spaced portions of the base of device 54 or 56 aligned with the alignable second and fourth pairs of spaced apertures 22, 24 and 48, 50 of wall plate 12 and bracket 30 whereby device 54 or 56 is attached to wall plate 12 and bracket 30. The outer peripheral edge of device 54 has a shape corresponding to and aligned with the shape of the outer peripheral edge of top surface 14 of the first boss of wall plate 12 as indicated in FIG. 1. Similarly, the outer peripheral edge of smaller device 56 has a shape corresponding to and aligned with the shape of the outer peripheral edge of top surface 16 of the second boss of wall plate 12 as shown in FIG. 2. Because of the elongated slot configurations of the fourth pair of apertures 48, 50 on bracket 30, the second and fourth pairs of apertures 22, 24 and 48, 50 on wall plate 12 and bracket 30 remain in alignment even though wall plate 12 is rotatably adjusted relative to bracket 30 during attachment of the wall plate to the bracket as aforedescribed.

Inasmuch as the present invention is subject to many modifications, variations and changes in detail, it is intended that all matter contained in the foregoing description and shown in the accompanying drawings shall be interpreted as illustrated and not in a limiting sense.

What is claimed is:

1. In a thermostat wall mounting assembly adapted to have mounted thereon a selected one of two different sizes of thermostats, the combination comprising a wall mounting bracket including a raised central portion with an opening defined therein and flange means connected to opposite ends of the raised central portion to secure it to a wall, and a wall plate secured to said wall mounting bracket and including a flange portion extending around the periphery of said wall plate, a first raised boss centrally disposed in said wall plate, and a second raised boss centrally disposed in the first raised boss and having an opening defined therethrough and aligned with the opening in said wall mounting bracket, such that said wall plate can receive a selected one of the two different size thermostats on a selected one of said first and second raised bosses.

2. A thermostat wall mounting assembly as claimed in claim 1 wherein the second raised boss on said wall plate has a pair of apertures defined therein on opposite sides of the opening therethrough and wherein said wall mounting bracket has a pair of apertures defined therein on opposite sides of the opening therethrough so that said wall plate can be secured to said wall mounting bracket through the pairs of apertures.

3. A thermostat wall mounting assembly as claimed in claim 2 wherein the second raised boss on said wall plate has an additional pair of apertures defined therein on opposite sides of the opening and wherein said wall mounting bracket has an additional pair of apertures defined therein on opposite sides of the opening.

* * * * *